United States Patent [19]

Taki

[11] 4,124,331

[45] Nov. 7, 1978

[54] AUTOMATIC CONTROL SYSTEMS FOR A WELL PUMP INSTALLATION

[75] Inventor: Tomohiko Taki, Ibaraki, Japan

[73] Assignee: Hitachi, Ltd., Tokyo, Japan

[21] Appl. No.: 755,934

[22] Filed: Dec. 30, 1976

[51] Int. Cl.[2] ..... F04B 49/02

[52] U.S. Cl. ..... 417/19; 417/44

[58] Field of Search ..... 417/18, 19, 36, 38, 417/44, 9; 200/83 R, 83 L

[56] References Cited

U.S. PATENT DOCUMENTS

| | | | |
|---|---|---|---|
| 1,294,497 | 2/1919 | Lovekin | 417/19 |
| 1,560,044 | 11/1925 | Derrick | 417/38 |
| 2,765,743 | 10/1956 | Hollinshead | 417/44 |
| 2,856,481 | 10/1958 | Ernst | 200/83 R |
| 2,922,002 | 1/1960 | Gilman | 200/83 L |
| 3,119,552 | 1/1964 | Thomann | 417/19 |
| 3,794,789 | 2/1974 | Bynum | 417/38 X |
| 3,858,014 | 12/1974 | Hughes | 200/83 R |
| 3,989,911 | 11/1976 | Perry | 200/83 L |

FOREIGN PATENT DOCUMENTS

| | | | |
|---|---|---|---|
| 1,498,476 | 9/1969 | Fed. Rep. of Germany | 417/19 |

*Primary Examiner*—Carlton R. Croyle
*Assistant Examiner*—Edward Look
*Attorney, Agent, or Firm*—Beall & Jeffery

[57] ABSTRACT

For a well pump installation, automatic control of the starting and stopping of the pump motor relies upon a simultaneous detection of the suction and delivery heads so that a single switch may perform the functions of both delivery pressure control and dry cutting-off.

9 Claims, 8 Drawing Figures

AUTOMATIC CONTROL SYSTEMS FOR A WELL PUMP INSTALLATION

BACKGROUND OF THE INVENTION

1. Field of the Invention

The present invention relates to an improvement in an automatic control system for a well pump installation and, more particularly, to a water pressure system to be incorporated in the automatic control system.

2. Description of the Prior Art

Conventionally, a well pump installation with an automatic control system is equipped with a dry cut-off relay adapted to stop a pump motor in case of a dry operation of the pump which may be incurred by, for example, an invasion of air through a deteriorated junction of a suction pipe, thereby to prevent burning of the pump motor and other troubles which may be incurred by the dry operation of the pump.

Since the conventional dry cut-off relay is so constructed as to stop the pump motor relying solely upon the suction head (usually, a negative pressure), the cut-off relay tends to erroneously operate to stop the pump motor when the normal water level in the well is extremely high or when the pump is installed beneath the normal water level.

SUMMARY OF THE INVENTION

It is therefore an object of the invention to provide an automatic control system for a well pump installation, which is free from the problem of the erroneous operation and capable of ensuring the dry cut-off function.

Under these circumstances, the present inventor has found, as a result of a series of experiments and studies, that the above described problem inherent in the conventional dry cut-off relay relying solely upon the suction head can be overcome by taking a delivery head into account in addition to the suction head.

Thus, according to the invention, there is provided an automatic control system for a well pump installation capable of controlling the starting and the stopping of the pump motor upon a simultaneous detection of the suction and the delivery heads.

It is another object of the invention to provide an automatic control system for a well pump installation having a pressure switch incorporated therein, the pressure switch being adapted to play double roles of a delivery pressure control (control the pump motor so as to start and stop it for maintaining the service pressure within a predetermined range) and the dry cutting-off in response to the suction and delivery heads.

In conventional automatic well pump systems, separate pressure switches are provided respectively for starting and stopping the pump motor in response to a pressure in a pneumatic tank, and for the dry cut-off. Thus, the electric circuits have been rendered complicated, and the installation of the control system has been troublesome and time-consuming, due to the assembling the separate pressure switches.

According to the invention, this shortcoming is fairly avoided by adoption of a single switch adapted to act in response to the suction and the delivery heads for playing double roles of the delivery or service pressure control and the dry cut-off.

These and other objects and advantageous features of the invention will become more clear from the following description of the preferred embodiment taken in conjunction with the attached drawings in which:

DESCRIPTION OF THE PREFERRED EMBODIMENT

Figure 1:
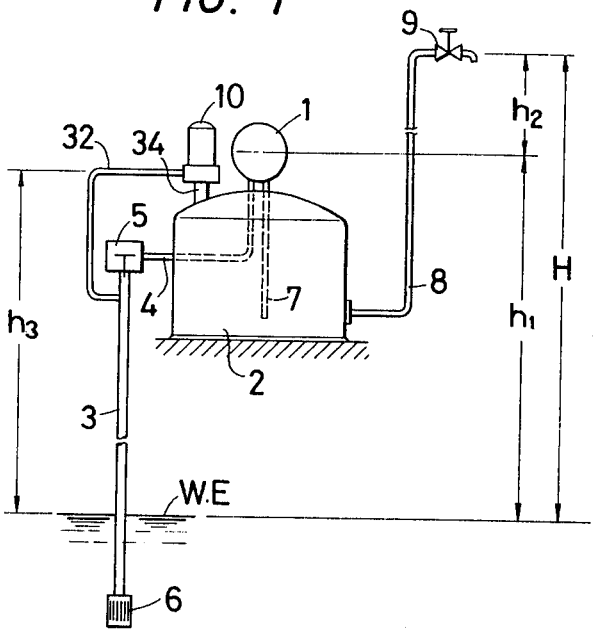
FIG. 1 is a schematic view of a well pump system showing an embodiment of the present invention.

Referring at first to FIG. 1, an automatic well pump system incorporates a pump 1 which may be a pump of wesco type and a pneumatic tank 2 connected to the delivery side of the pump 1 and on which the pump 1 is mounted. A suction pipe 3 is connected to the suction side of the pump 1 through a suction intermediate pipe 4 which runs through the pneumatic tank 1. A check valve 5 of known type is provided in the suction pipe 3. The suction pipe 3 is further provided with a suction strainer 6 at its lower end which is located within a well W.E. A delivery intermediate pipe 7 connected at its one end to the delivery side of the pump 1 opens at its other end into the space within the pneumatic tank 1, while a delivery pipe 8 opens in the pneumatic tank 2 and leads to a faucet 9.

The automatic well pump installation as schematically shown in FIG. 1 is controlled by a controller 10 adapted to control the starting and stopping of the pump 1 in response to the pressure in the delivery pneumatic tank 2 and the suction head in the suction pipe 3 connected to the suction side of the pump.

As will be explained later in more detail, the controller 10 is adapted to play double roles of pressure control and dry cut-off.

Figure 2:
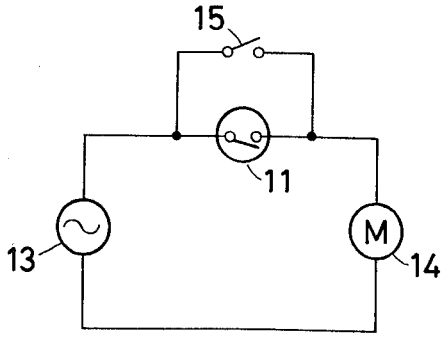
FIG. 2 is a circuit diagram of a preferred embodiment of the present invention.

FIG. 2 shows an electric circuit which renders the controller 10 capable of functioning as a pressure switch. Referring to FIG. 2, a pressure switch 11 is electrically connected on one hand to a source 13 and to a pump motor 14 on its other hand. A start switch 15 is connected in parallel with the pressure switch short-circuiting the latter. As will be explained later, the start switch is used for the initial starting of the pump.

The controller is adapted to operate in response to a total head H (see FIG. 1) which is the sum of the suction pressure and the delivery pressure. As detailed in FIGS. 3, 4 and 5, the controller 10 mainly consists of a pressure detector 16, a switching portion 17 and an outputting portion 18 for transmitting a force from the pressure detecting portion 16 to the switching portion 17.

The pressure detector 16 comprises two diaphragms 19 and 20. One 19 of the diaphragms is made of rubber or the like material, and is for detecting the delivery pressure which is the pressure in the pneumatic tank 2 in an embodiment. For this reason, the diaphragm 19 will be referred to as a "delivery-side diaphragm", hereinafter. The delivery-side diaphragm 19 is clamped at its peripheral portion between a lower case 21 having a pressure-transmitting port 28 and an intermediate case 22, so that the central portion of the diaphragm can deflect freely.

Another diaphragm 20, which also may be made of rubber or the like material, is for detecting the pressure at the suction side of the pump, and, therefore, will be referred to as a "suction-side diaphragm", hereinafter. The suction-side diaphragm 20 is clamped at its peripheral portion between a movable fixing plate 23 and a flange surface 24A of a flange of pressure-receiving disc 24. The pressure-receiving disc 24 is adapted to be actuated by the delivery-side diaphragm 19 as a pressure is applied to the latter.

A boss 26 having a central bore 25 is pressed into a supporting portion 29 of an upper case 27, so as to support the central portion of the suction-side diaphragm 20.

When the suction-side diaphragm is attached in the described manner, a first pressure chamber 30 is formed between the surfaces of the suction-side diaphragm 20 and the pressure-receiving disc 24. The first pressure chamber 30 is connected to the suction side of the pump 1, through a pressure-transmitting passage 31 formed in the upper case 27 and, then, through a pressure-transmitting pipe 32 (See FIG. 1).

To explain in more detail, the pressure-transmitting pipe 32 has one end connected to the upper case 27 and the other end connected to the suction pipe 3 upstream of the check valve 5, so as to provide an intercommunication between the first pressure chamber 30 and the suction side of the pump 1.

Figure 5:
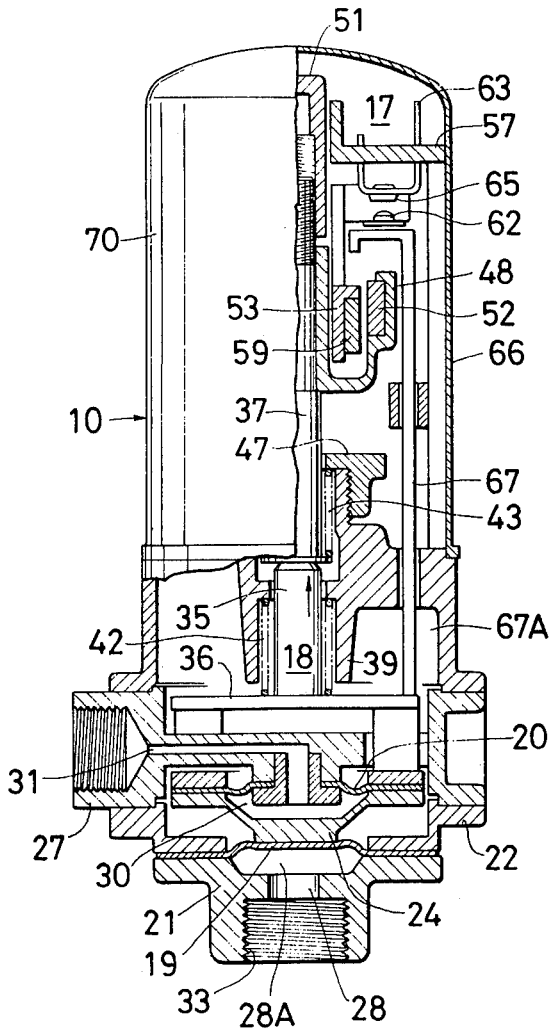

As will be seen from FIG. 5, a second pressure chamber 28A is defined by a pressure-receiving surface of the delivery-side diaphragm 19 and an inner surface of the lower case 21. A pipe 34(See FIG. 1) having one end connected to a junction port 33 of the lower case 21 and the other end connected to the pneumatic tank 2 provides a communication between the second pressure chamber 28A and the space in the pneumatic tank 2, i.e. the delivery side of the pump 1.

An output shaft 35 which is a part constituting the outputting portion 18 is unitarily connected to a central portion of a disc plate 36 housed by the upper case 27. The output shaft 35 has one end which engages the end of a movable rod 37 adapted to act on the switching portion 17, and is housed by an inner sleeve 39 of an upper base 38.

The movable fixing plate 23 is comprised of a plurality of auxiliary output shafts 40A and 40B. The auxiliary output shafts extend through respective guide ports 41 and are connected at their upper ends to the disc plate 36.

An elastic member 42 consisting of a compression spring is disposed within the inner sleeve 39 of the upper base 38, so as to surround the output shaft 35. The elastic member 42 extends between the surfaces of the disc plate 36 and the inner sleeve 39, thereby to normally bias the outputting portion 18 downwardly. Alternatively, the elastic member may be provided outside and around the inner sleeve 39.

In the construction explained above, as the pressures are applied to the suction-side and the delivery-side diaphragms which are fixed at peripheries and allowed to deflect at the central portions, the diaphragms deflect and the resultant force is transmitted to the switching portion 17, through the outputting portion 18 consisting of the auxiliary output shafts 40A and 40B, disc plate 36 and the output shaft 35, so as to open and close the switching portion (This will be detailed later.) 17 for opening and closing the electric circuit for the motor 14, thereby to start or stop the pump 1.

The upper base 38 is adapted to be mounted on the upper case 27, and is provided with an upper receiving bore 44 for receiving the movable rod 37 and a main elastic member 43.

The main elastic member 43 is housed by the receiving bore 44 so as to surround the movable rod 37 which partially is received by the receiving bore 44. The main elastic member rests, at its one end, on a flange 45 formed at an end of the movable rod 37.

Figure 4:
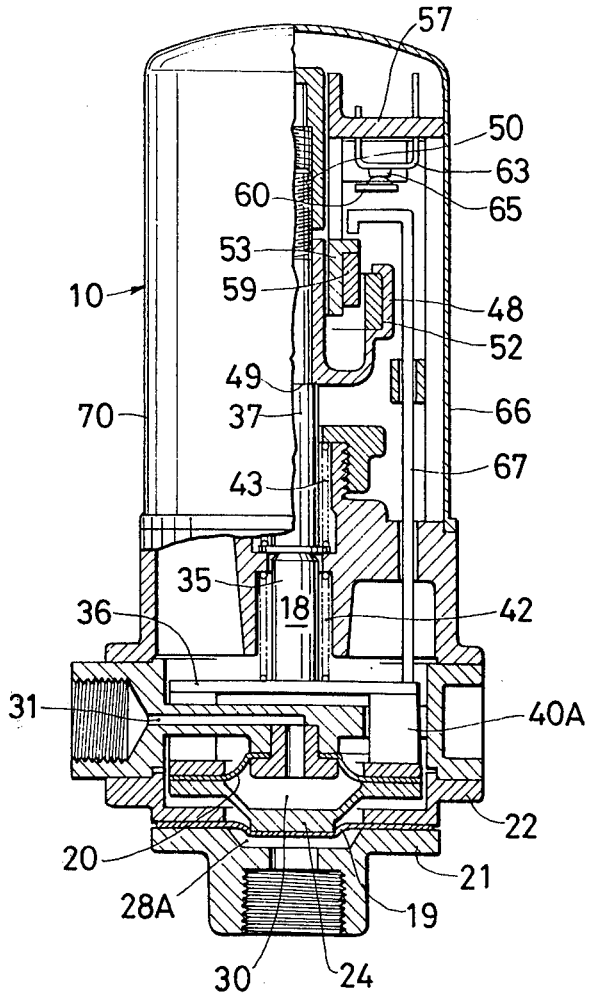

An adjusting member 47 (In the explained embodiment, a nut constitutes the adjusting member.) is adjustably screwed unto an annular wall 46 defining the receiving bore 44. The other end of the main elastic member acts against the inner end surface of the adjusting means 47. The arrangement is such that the downward and axial biasing force exerted by the main elastic member 43 on the movable rod 37 is varied by adjusting the adjusting means 47. A predetermined gap G is preserved between the opposing axial ends of the movable rod 37 and the output shaft 35. The gap G accordingly vanishes as the axial end of the output shaft 35 comes in contact with the movable rod 37, as shown in FIGS. 4 and 5, which contact takes place when the movable rod 37 is pressed by the output shaft 35 of the outputting portion 18.

An annular outer slider 48 is abutted at its lower end by a shoulder 49 of the movable rod 37 and, therefore, is fixed to the movable rod 37.

The movable rod 37 is threaded at its upper portion as designated at 50, onto which adjustably screwed is an adjusting knob 51.

A cylindrical magnet 52 is disposed within the outer slider 48.

An inner slider 53 is loosely received by the outer slider 48, and is suspended by a vertical arm 54 which is integral with a horizontal arm 55. A guide pin (See FIG. 6, 7 or 8) 56 is disposed above the horizontal arm 55 and is adapted to be received by a bore 58 formed in an attaching base 57, thereby to correctly position the inner slider 53. The upper surface of the horizontal arm 55 is abutted by the lower surface of the attaching base 57. Another cylindrical magnet 59 is provided around the inner slider 53. The another magnet 59 has a polarity which is same with that of the first mentioned magnet 52. Thus, the magnet 52 and the magnet 59 will be referred to as an outer magnet and an inner magnet, respectively.

Referring to the switching means 17, a movable piece 60 has one free end and the other end fixed to the attaching base 57.

The movable piece 60 is made of phosphor bronze or the like material mechanically and is bent to have a U-shape.

The attaching base 57 has an upwardly projecting portion which serves as an electric terminal for the power supply.

The U-shaped movable piece 60 is provided with at its free end a movable contact 62.

A fixed piece 63 which is also a constituent of the switching portion 17 is mechanically bent to be fixed to the attaching base 57 at a portion which serves as an electric terminal 64 for the power supply. A fixed contact 65 is secured to the fixed piece 63 so as to confront the movable contact 62.

Figure 6:
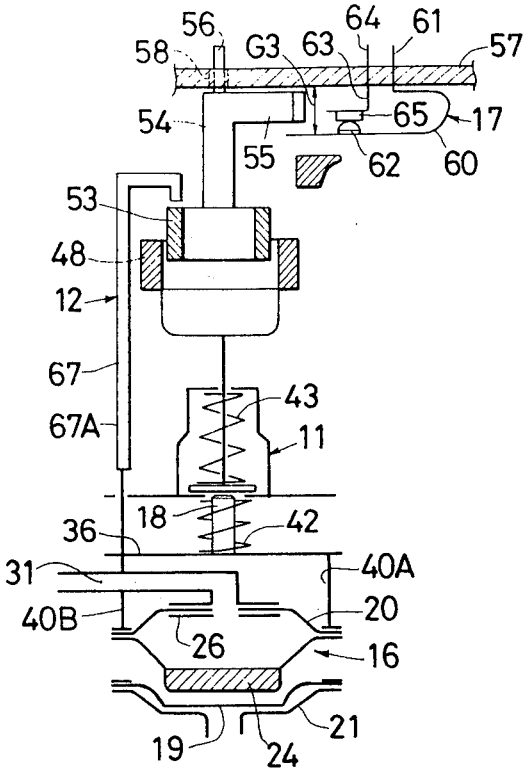
FIGS. 6, 7 and 8 are schematic views explanatory of the operation of the system in accordance with the present invention.
Figure 7:
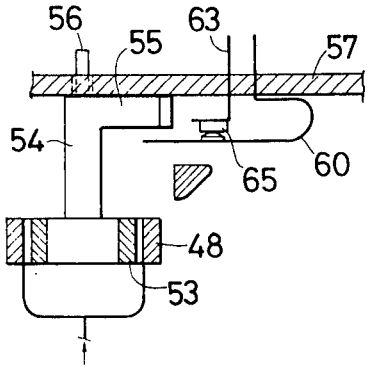

As will be seen from FIGS. 6 and 7, that a gap G3 is formed between the lower surface of the attaching base 57 and the free end side of the movable piece 60 beyond the movable contact 62, and is confronted by the horizontal arm 55.

The inner slider 53 is prevented from displacing laterally, by the guide pin 56 received by the bore 58 of the attaching base 57, but is allowed to move vertically.

The attaching base 57 is secured unitarily to the aforementioned upper base 38, through a supporting column 66. The attaching base 57, upper base 38 and the supporting column 66 are preferably made of a synthetic resin, as well as the vertical and the horizontal arms 54, 55 and the guide pin 56, so as to ensure a good insulation and a good workability for manufacturing those components.

Figure 3:
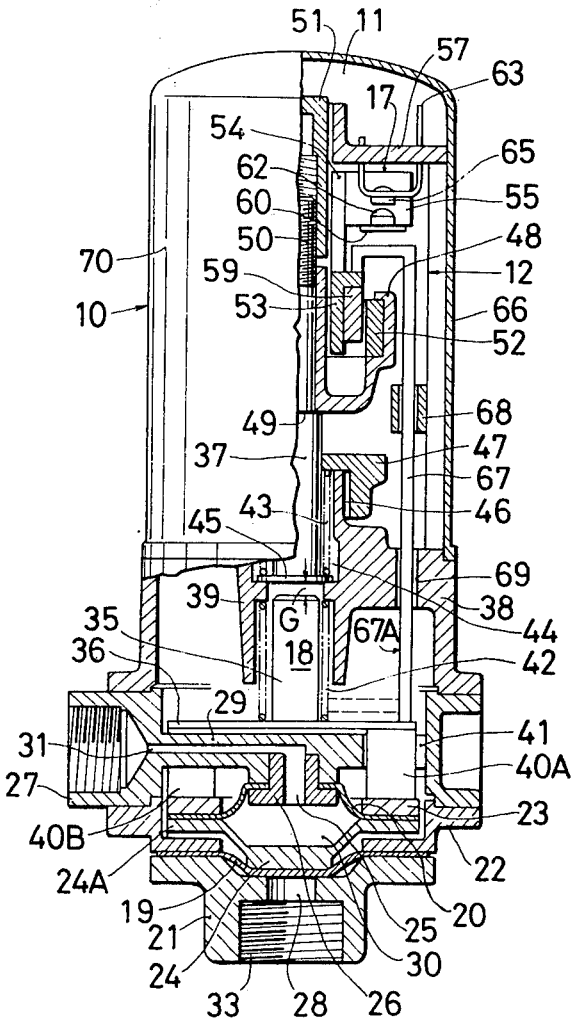
FIGS. 3, 4 and 5 are fragmentary cross-sectional views of a control device showing an embodiment of the present invention.

The controller 10 has a dry cut-off relay 12 having an auxiliary outputting portion 67A composed of a lever 67. The lever 67 is fixed at its lower end to the disc plate 36 constituting the outputting portion 18, as shown in FIG. 3 or 6, while the upper end of the lever 67 is hooked and in contact with the upper surface of the inner slider 53.

The lever passes through a guide bore 69 formed in the upper base 38 and a guide portion 68 formed at an intermediate portion of the column 66. The guide portion 68 and the guide bore 69 are effective to guide the lever 67 when it moves vertically, and to prevent the lateral swinging of the lever 67.

The lever 67 which constitutes the auxiliary output portion 67A for the dry cutting-off means 12 operates in the following manner, when the controller 10 performs the dry cut-off function.

The resultant or combined stroke of the diaphragms 19 and 20 of the pressure detector 16 which detects the suction and the delivery pressures is transmitted to the outputting portion 18. The lever 67 is moved up and down by the disc plate 36 which is a constituent of the outputting portion 18.

Assuming that the lever 67 is moved downwardly, i.e. toward the pressure detector 16, the hooked end of the lever 67 comes in contact with the upper surface of the inner slider 53, thereby to depress the latter, so that the horizontal arm 55 unitary with the inner slider 53 depresses the movable piece 60. Consequently, the movable and the fixed contacts 62 and 65 are parted from each other, in the switching means 17.

The pump motor 14 is controlled to start and stop, as the switching means 17 closes and opens in the manner explained above. As will be mentioned later, the pump motor is stopped when air invades the suction pipe 3.

In the described embodiment, a motion is transmitted from the pressure detector 16 to the outputting portion, while the outputting portion 18 in turn transmits the movement to the contacts 62 and 65 which act as the switching portion 17 of the controller 10. The auxiliary outputting portion 67A is constituted by a lever 67 connected to the disc plate 36. Alternatively, the lever 67 may be connected to the output shaft 35, as illustrated in broken line in FIG. 3, or to the movable fixing plate 23. The opening and closing of the switching portion 17 can be accomplished by means other than the lever 67, such as a rope connected to the inner slider 53.

A cover designated at 70 is secured to the upper end of the upper base 38 to cover the switching portion 17 and to protect the whole structure. Alternatively, the cover 70 can have an axial length large enough to reach the root portion of the upper cover 38, so as to enclose the latter. The cover 70 is preferably made of a synthetic resin.

Turning again to FIG. 1, suction head, delivery head, suction level and total head are respectively designated at $h_1$, $h_2$, $h_3$ and H. The manner of operation of the controller 10 will be described hereinafter.

Prior to the starting of the pump 1, the pump 1 is filled with a priming water. At this moment, no pressure is applied to the first and the second pressure chambers 30 and 28G. Therefore, the force exerted by the elastic member 42 biases the pressure detector 16 including the diaphragms 19 and 20, along with the outputting portion 18, as shown in FIG. 3. The lever 67 of dry cut-off relay 12 is at its lowered position along with the outputting portion 18 and is biasing the inner slider 53 downwardly. Consequently, the horizontal arm 55 which moves unitarily with the inner slider 53 biases the movable piece 60 downwardly to part the contacts 62 and 65 from each other, i.e. to open the switching means 17.

As the start switch 15 (See FIG. 2) is closed, the pump commences its work, and the water is pumped up in several minutes.

At this time, since a negative pressure corresponding to the suction head $h_1$ (See FIG. 1) exists in the suction pipe 3, the suction-side diaphragm 20 of the controller 10 defining the first pressure chamber 30 detects this negative pressure and is deflected upwardly, in response to which the lever 67 connected to the disc plate 36 of the outputting means 18 moves upwardly to release the inner slider 53.

The inner magnet 59 secured to the inner slider 53 is magnetized to have the same polarity with the other magnet 52 secured to the outer slider 48, so that both magnets repulses each other. The repulsion force then moves the inner slider 53, since the outer slider 48 is supported by the shoulder 49 of the movable rod 37. Consequently, the horizontal arm which moves along with the inner slider 53 comes to release the movable piece 60 so as to allow the contacts 62 and 63 to contact with each other. The starting switch 15 is then opened.

The working of the pump displaces the water through the pneumatic tank 2 building up a pressure in the pneumatic tank 2. Accordingly, the delivery pressure is applied to the second pressure chamber 28A. The pressures in the first and the second pressure chambers 30 and 28A deflects the diaphragms 19 and 20, as shown in FIG. 4, thereby to continue the running of the pump 1.

To explain in more detail, the running of the pump 1 causes the deflections or displacements of the diaphragms 19 and 20 of the pressure detector 16, so that the resultant displacements of the diaphragms is transmitted to the outputting portion 18.

Accordingly, the outputting portion 18 is shifted from the position of FIG. 3 to the position of FIG. 4, resisting the biasing force of the elastic element 42. Thus, the outputting portion as a whole moves upwardly, so that the output shaft 35 of the outputting portion 18 comes in contact with the movable rod 37, so as to cancel the gap G which has been maintained therebetween. Thus, the output shaft 35 then exerts a force which tends to lift the movable rod 37 axially and upwardly, as shown in FIG. 4.

However, since the delivery pressure (In this embodiment, the delivery pressure is the pressure in the pneumatic tank 2) is still low, the output shaft 35 only contacts the axial end of the movable rod 37 and cannot move the movable rod 37 upwardly to open the switching means 17.

Thus, when the controller 10 acts as a pressure switch 11, the pump goes on running until the delivery pressure of the pump 1 gets higher than a predetermined opening pressure, which pressure is obtained only by closing the faucet 9 provided at the end of the delivery or discharge pipe 8. The controller 10 is kept in a condition as shown in FIG. 4, as long as the pump 1 goes on running with faucet 9 open.

As the opening degree of the hydrant 9 at the end of the delivery pipe 8 is decreased to reduce the water consumption, the pressure in the pneumatic tank 2 increases gradually.

The pressure in the pneumatic tank 2 further increases as the hydrant 9 is closed. The increased pressure is detected by the delivery-side diaphragm 19 defining the second pressure chamber 28A of the controller 10, resulting in an further displacement of the delivery-side diaphragm 19. Consequently, a force corresponding to the total head H (FIG. 1) resulted from the increased delivery pressure applied to the delivery-side diaphragm 19 and the suction pressure applied to the suction-side diaphragm 20 is applied to the outputting portion 18, thereby to move the later upwardly. Consequently, the output shaft 35 of the outputting portion 18 is moved upwardly, to move the movable rod 37 which has been in contact with the output shaft 35 in the same axial direction with the output shaft 35.

As the movable rod 37 is moved upwardly resisting the biasing force of the main elastic member 43, by the output shaft 35, the outer slider 48 secured to the movable rod 37 and the outer magnet 52 carried by the outer slider 48 are moved upwardly unitarily with the movable rod 37, in the same direction with the later.

Consequently, the outer magnet 52 performs a relative upward movement with respect to the inner magnet 59 which has been lifted up toward the attaching base 57. The repulsion force acting between the inner and the outer magnets 59 and 52 is abruptly reversed soon after the outer magnet 52 passes the height of the inner magnet 59 (i.e. the dead center), and the reversed repulsion force acts downwardly.

In a short period of time, typically in one second, i.e. instantaneously, the inner slider 53 is lowered to move the horizontal arm 55 carried by the inner slider 53 downwardly, so that the movable piece 60 is moved downwardly to part the movable contact 62 from the fixed contact 65, thereby to open the source circuit.

Consequently, the motor 14 for driving the pump 1 is stopped so that the pump 1 stops its work. When the motor is stopped as described above, the controller 10 is in a condition as shown in FIG. 5. Thus, the pump is stopped as the controller 10 is shifted from the condition of FIG. 4 to the condition of FIG. 5.

As the faucet 9 at the end of the delivery pipe 8 is opened again to start the delivery, the water in the delivery pipe 8 and in the pneumatic tank 2 is released through the faucet 9 and the pressure in the pneumatic tank 2 is lowered accordingly.

Therefore, the delivery pressure applied to the delivery-side diaphragm of the controller 10 is lowered to decrease the resultant force applied by the diaphragms 19 and 20 to the outputting portion 18.

Consequently, the outputting moved downwardly includes its output shaft 35, so that the upper end of the output shaft 35 is allowed to part from the lower end of the movable rod 37 to regenerate the gap G therebetween. The upward biasing force on the movable rod 37 is then released, so that the movable rod 37 is moved downwardly by the main elastic member 43.

This downward movement of the movable rod 37 is followed by the downward movements of the outer slider 52 adapted to be moved unitarily with the movable rod 37 and of the outer magnet carried by the outer slider 52.

As the aforementioned dead center is passed by the outer magnet 52, the inner slider 53 is instantaneously moved upwardly until it abuts the lower surface of the attaching base 57. The horizontal arm adapted to move unitarily with the inner slider 53 then stops depressing the movable piece 60.

Consequently, the movable piece 60 is allowed to return to its initial position as shown in FIG. 7, so as to make the movable contact 60 get in touch with the fixed contact 65. The controller 10 is then shifted from the condition of FIG. 5 to the condition of FIG. 4, so that the pump motor 14 is restarted to allow the pump 1 to commence the pumping (See FIG. 4). The controller 10 as the pressure switch 11 repeats the operation as described above for starting and stopping the pump motor 14.

In addition to the role of the pressure switch 11, the controller at the same time plays the role of dry cut-off, by the dry cut-off relay 12.

Hereinafter, the manner of operation of the controller 10 to perform the function of the dry cut-off relay 12 will be described.

Under a normal or usual running condition of the pump 1, the delivery pressure of the pump is maintained sufficiently high. Therefore, the force applied to the delivery-side diaphragm 19 of the controller 10 is sufficiently large to displace the outputting means 18 upwardly.

Namely, as have been described, under the normal running condition of the pump 1, the delivery and the suction pressures are applied respectively to the suction and delivery-side diaphragms 19 and 20 of the pressure detector 16 so that the resultant displacements of these diaphragms is transmitted to the outputting portion 18. In other words, under the normal running condition of the pump 1, the outputting portion 18 as a whole is moved upwardly.

Needless to say, the output portion 18 is kept raised, even if the pump 1 is stopped, provided that a high delivery pressure is applied to the delivery-side diaphragm. Thus, the outputting portion 18 is raised not only during the running of the pump 1 but during the suspension or the stopping of the pump as well.

When the outputting portion 18 is raised as a whole, the lever 67 of the dry cut-off portion 12, which is secured to the disc plate 36 of the outputting portion 18 is raised to part its hooked end from the upper surface of the inner slider 53. Therefore, the lever 67 of the dry cutting-off portion does not depress the inner slider 53, so that the contacts 62 and 65 do not part from each other, thus ensuring the running of the pump 1.

Supposing that there is an invasion of air to the suction pipe 3 through a deteriorated junction (not shown) or due to an excessive lowering of the water level, the pressure in the suction pipe 3 comes up to atmospheric pressure, while the delivery pressure of the pump 1 is lowered also to the atmospheric pressure because no water is pumped.

Under this condition, since the pressure differential between the first and the second pressure chambers 30, 28A of the controller which now acts as the dry cut-off relay 12 is lost, the upward biasing force which has been applied to the outputting portion 18 vanishes. The outputting portion 18 as a whole is then depressed downwardly by the elastic member 42 and the main elastic member 43. The lever 67 of the dry cut-off relay 12 is then moved in the same direction as the outputting portion 18 so as to depress the inner slider 53.

Figure 8:
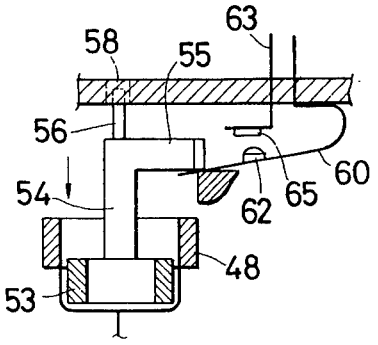

Consequently, the horizontal arm unitary with the inner slider 53 depresses the movable piece 60, so that the movable and the fixed contacts are parted from each other, as shown in FIG. 8, thereby to stop the pump motor 14 and, accordingly, the pump 1.

In the described operation of the controller 10 for a well pump installation, the safe operation of the dry cutting-off means 12 incorporated in the controller 10 is ensured by the double detection of the suction and the delivery pressures. Namely, since the dry cutting-off portion relay responds to both of the suction and the delivery pressures, the delivery pressure is effective to prevent the opening of the switching portion 17 that otherwise would be caused by a depression of the lever 67 by the suction-side diaphragm for detecting the suction pressure, when the suction pressure is high due to an extraordinary raising of the water level or due to the installation of the pump beneath the water level. To explain in more detail, the delivery-side diaphragm 19 sensitive to the delivery pressure is effective to move the outputting portion 18 upwardly resisting the downward biasing force by the suction-side diaphragm at high pressure. Since the lever 67 is maintained at its lifted position, due to the upward positioning of the outputting portion 18 by the delivery-side diaphragm 19, the lever 67 of the dry cut-off relay 12 does not act to open the switching means.

Thus, the erroneous operation of the dry cut-off relay of the controller 10 attributable to the raising of the water level or to the underwater installation of the pump 1 is avoided, ensuring a safe operation of the dry cut-off relay 12.

It will be understood from the foregoing description that, according to the invention, a controller for a well pump installation having dry cut-off relay is provided for controlling a pump motor to start and stop it upon double detections of the suction and the delivery pressures, the safe operation of the dry cut-off relay being ensured by the double detections.

The construction of controller having a double functions of the pressure switch and a dry cut-off relay can be greatly simplified, due to the common use of each constituent, when the outputting portion adapted to open and close switching portion in response to a movement of a pressure detector which is sensitive to both the suction and the delivery pressures are provided with dry a cut-off relay for opening and closing the switching means.

Conventionally, as mentioned before, well pump installations have been equipped with pressure switches and a dry cut-off relay constructed separately from each other, which have caused difficulties in attaching the pressure switches and the dry cut-off relay separately and electrically connecting them to each other.

However, these difficulties are not present and the common use of the parts is possible, in one embodiment of the present invention capable of performing a double functions.

Thus, according to one embodiment of the present invention, a controller for a well pump installation capable of performing a double functions of a pressure switch and dry cut-off relay having a simple structure is obtained.

Although a repulsion force exerted by magnets is used for a quick-switching of the switching means in the foregoing embodiment, it is fairly possible to substitute springs, as is well know, for the magnets so as to obtain the quick-switching.

Although a preferred embodiment has been described with specific terms, this is not exclusive, and many changes and modifications may be imparted thereto without departing from the scope of the invention which is limited solely by the appended claims.

What is claimed is:

1. An automatic control system for a well pump installation comprising:

first means for detecting a pressure at the suction side of the pump, second means for detecting a pressure at the delivery side of the pump, outputting means operable in response to the pressure of said suction and delivery sides detected by said first and second pressure detecting means, and switching means operable in response to said outputting means to control the operation of a motor for driving the pump so that said switching means starts the operation of said motor when a sum of the pressures detected by said first and second means drops below a first fixed pressure higher than an atmospheric pressure, and stops the operation of said motor when the sum of the pressures detected by said first and second means exceeds a second fixed pressure higher than said first fixed pressure and when both of the pressures of suction and delivery (a dry cut-off relay adapted to stop a motor for driving said pump when the pressures detected by said detecting means) are the atmospheric pressure.

2. An automatic control system for a well pump installation comprising:

A casing, first means having a first diaphragm supported within said casing so as to be deflected in response to a pressure at the suction side of the pump, second means having a second diaphragm supported within said casing so as to be deflected in response to a pressure at the delivery side of the pump, outputting means movable in response to the deflections of said first and second diaphragms, and switching means operable in response to the movement of said outputting means to control the operation of a motor for driving the pump, so that said switching means starts the operation of said motor when a sum of the pressures detected by said first and second means drops below a first fixed pressure higher than an atmospheric pressure, and stops the operation of said motor when the sum of the pressures detected by said first and second means exceeds a second fixed pressure higher than said first fixed pressure and when both of the pressures of suction and delivery are the atmospheric pressure.

3. An automatic control system for a well pump installation system as claimed in claim 2, wherein said switching means includes only a single set of electrical contacts in electrical series with the motor to be driven both open and closed for respectively stopping and running the motor by only said first and second means.

4. An automatic control system for a well pump installation according to claim 3, wherein said first and second means each include an expansible chamber device drivingly connected in tandem with said electrical contacts.

5. An automatic control system for a well pump installation according to claim 2, wherein both said first and second means include an expansible chamber device, and said expansible chamber devices are drivingly interconnected in tandem to commonly drive said switching means 6. An automatic control system for a well pump installation comprising a delivery-side diaphragm fixed at its peripheral portion and capable of deflecting at its central portion in response to a delivery pressure of a pump, a pressure-receiving disc supported by said central portion of said delivery-side diaphragm, a suction-side diaphragm fixed at its peripheral portion to said pressure-receiving disc and statically supported at its central portion, said suction-side and said delivery-side diaphragms defining a pressure chamber, a passage for introducing a suction pressure of said pump into said pressure chamber, and switching means adapted to control a motor for driving said pump being actuated in response to a stroke of said pressure-receiving disc.

7. An automatic control system for a well pump installation as claimed in claim 6, wherein said switching means stops said motor when said suction and said delivery pressures are atmospheric pressure in accordance with a first position of said disc, allows the drive of said motor when the sum of said suction and said delivery pressures is lower than a second predetermined pressure which is higher than the atmospheric pressure in accordance with a second position of said disc, and stops said motor when said sum exceeds a third predetermined pressure which is higher than said second predetermined pressure in accordance with a third position of said disc.

8. An automatic control system for a well pump installation as claimed in claim 6, wherein said switching means responsive to said stroke of said pressure-receiving disc is a pair of electric contacts connected in series to said motor.

9. An automatic control system for a well pump installation comprising: a delivery-side diaphragm supported statically at its periphery and movable at its central portion and adapted to be deflected in response to a delivery pressure of a pump, said delivery-side diaphragm being adapted to receive said delivery pressure at its one side and carrying at its central portion in the other side a pressure-receiving disc, a suction-side diaphragm fixed at its periphery to said pressure-receiving disc and statically supported at its central portion, said delivery and suction-side diaphragms defining therebetween a first pressure chamber, a passage for introducing a fluid of a pressure corresponding to the suction head or pressure of said pump into said first pressure chamber, a pair of electric switch contacts, a lever secured to said pressure-receiving disc and adapted to keep said pair of electric contacts away from each other when both of said suction and said delivery pressures are atmospheric pressure, said contacts being connected in series to a motor for driving said pump, said lever having a movable rod adapted to put said contacts in contact with each other by a stroke of said pressure-receiving disc when said suction and said delivery pressures are normal, said movable rod being held opposing to said pressure-receiving disc with a certain gap and adapted to be moved in the same direction with said pressure-receiving disc, said movable rod being further adapted to part said contacts from each other by said stroke of said pressure-receiving disc when the sum of said suction and delivery pressures exceeds a predetermined pressure higher than that of said normal suction and delivery pressures.

* * * * *